US012543874B2

(12) United States Patent
Dawson

(10) Patent No.: US 12,543,874 B2
(45) Date of Patent: Feb. 10, 2026

(54) ADJUSTABLE SLEEPING BAG

(71) Applicant: Cascade Designs, Inc., Reno, NV (US)

(72) Inventor: Louis Dawson, North Bend, WA (US)

(73) Assignee: Cascade Designs, Inc., Reno, NV (US)

( * ) Notice: Subject to any disclaimer, the term of this patent is extended or adjusted under 35 U.S.C. 154(b) by 3 days.

(21) Appl. No.: 18/410,429

(22) Filed: Jan. 11, 2024

(65) Prior Publication Data

US 2025/0228381 A1 Jul. 17, 2025

(51) Int. Cl.
*A47G 9/08* (2006.01)
*A47G 9/00* (2006.01)

(52) U.S. Cl.
CPC ..... *A47G 9/086* (2013.01); *A47G 9/083* (2013.01); *A47G 9/08* (2013.01)

(58) Field of Classification Search
CPC ..... A47G 9/086; A47G 9/083; A47G 9/08
USPC ..... 5/413 R, 413 AM; 2/69.5, 69
See application file for complete search history.

(56) References Cited

U.S. PATENT DOCUMENTS 3,857,125 A * 12/1974 Hunt ..... A47G 9/086 5/413 R
3,878,574 A 4/1975 Erickson
3,959,834 A * 6/1976 Hunt ..... A47G 9/086 5/413 R
4,090,269 A * 5/1978 Hunt ..... A47G 9/086 5/413 R
4,507,805 A 4/1985 Calutoiu
4,787,105 A 11/1988 Phillips et al.
4,989,282 A * 2/1991 Goldstein ..... A47G 9/083 5/413 R
5,386,602 A * 2/1995 Krenzler ..... A47G 9/086 5/413 R
5,815,833 A * 10/1998 Kuo ..... A47G 9/086 5/413 AM
5,960,492 A * 10/1999 Byrne ..... A47G 9/086 5/413 R (Continued)

FOREIGN PATENT DOCUMENTS

WO WO-2025151877 A1 * 7/2025 ..... A47G 9/086

OTHER PUBLICATIONS

International Patent Application No. PCT/US2025/011423; Int'l Search Report and the Written Opinion; dated Mar. 19, 2025; 16 pages.

(Continued)

*Primary Examiner* — Robert G Santos
(74) *Attorney, Agent, or Firm* — BakerHostetler

(57) ABSTRACT

A sleeping bag including an insulated tube open at a first longitudinal end and closed at a second longitudinal end, wherein the insulated tube has a bottom side and a top side. The sleeping bag includes an outer shell, an inner liner, and insulation material enclosed by the outer shell and the inner liner. The sleeping bag includes an expansion panel on the top with a narrower end positioned nearest the first longitudinal end, a wider end positioned nearest the second longitudinal end, and a zipper. The zipper includes first and second portions running longitudinally along the top of the sleeping bag on either side of the expansion panel and a zipper slider. The zipper slider zips the first and second portions of the zipper together to close the expansion panel and unzips the first and second portions of the zipper to open the expansion panel.

19 Claims, 7 Drawing Sheets

(56) References Cited

U.S. PATENT DOCUMENTS

| | | | | |
|---|---|---|---|---|
| 6,073,282 | A * | 6/2000 | Leeper | A47G 9/086 5/413 R |
| 6,175,976 | B1 * | 1/2001 | Cantwell | A47G 9/086 5/413 R |
| 6,216,290 | B1 | 4/2001 | Zemitis et al. | |
| 6,438,774 | B1 * | 8/2002 | Michaelis | A47G 9/086 5/413 R |
| 7,181,785 | B2 * | 2/2007 | Dinan | A47G 9/086 5/413 R |
| 7,849,534 | B2 | 12/2010 | Bellick et al. | |
| 11,534,011 | B2 | 12/2022 | House et al. | |
| 2005/0034234 | A1 * | 2/2005 | Bellick | A47G 9/086 5/413 R |
| 2006/0137093 | A1 | 6/2006 | Dinan et al. | |
| 2020/0390254 | A1 * | 12/2020 | House | A47G 9/086 |
| 2022/0232917 | A1 | 7/2022 | Lee et al. | |
| 2025/0228381 | A1 * | 7/2025 | Dawson | A47G 9/086 |

OTHER PUBLICATIONS

R. Kerkeling; "ISPO Award Winner 2023: Specter by Mountain Hardwear"; https://www.ispo.com/en/promotion/ispo-award-winner-mountain-hardwear-specter-sleeping-bag; ISPO; Nov. 2023; accessed Jan. 23, 2024; 3 pages.

* cited by examiner

ADJUSTABLE SLEEPING BAG

TECHNICAL FIELD

The present disclosure relates to outdoor recreation equipment and more particularly to a sleeping bag designed to adjust shape.

BACKGROUND

Many people own sleeping bags for use in outdoor recreational activities, or when it may otherwise be inconvenient or impractical to have a full mattress or bed. Sleeping bags come in a variety of shapes, sizes, insulation levels, and other attributes. Consumers must determine what attributes are required when deciding to purchase one of the numerous available sleeping bags on the market today. One of the main differences between sleeping bags is the level of warmth provided.

Light sleeping bags, meaning sleeping bags with less insulation, may provide very little heat retention. However, in a summer camping scenario very little heat retention is often desired to prevent a user from overheating while sleeping. To the contrary, heavy sleeping bags, meaning sleeping bags with more insulation, may provide extremely high heat retention, allowing for users to sleep in harsh conditions. However, sleeping bags typically only provide one option for the amount of heat retention and breathability. To add warmth to a sleeping bag, a user may be forced to simply drape a blanket on top of the sleeping bag. It may be difficult for a user to find the blanket and drape it over the sleeping bag during the middle of the night if the blanket falls off the sleeping bag. In the opposite scenario, reducing the heat retained by a sleeping bag may only be possible by unzipping an entrance zipper of the sleeping bag to promote air flow. Doing so may allow environmental debris, animals and insects to enter the inside of the sleeping bag, or a user may roll out of the sleeping bag while sleeping. Moreover, opening the entrance zipper of a sleeping bag to regulate heat retention is difficult to fine-tune and may cause a loss of too much heat, leading to a user becoming too cold while using the sleeping bag.

Regardless of the insulation weight of a sleeping bag, the shape of the sleeping bag may also play a role in heating and cooling. Sleeping bags that are designed to retain more heat tend to be mummy shaped, which means that the end of the sleeping bag where the user's head is located is broader than the end of the sleeping bag where the user's feet are located. This results in the inner liner of the sleeping bag, and therefore the insulation, being closer to the user's body and better able to retain heat near the user. Sleeping bags that are designed to be less heat retentive tend to be rectangularly shaped, with head end of the sleeping bag approximately the same width as the feed end of the sleeping bag. Rectangular shaped sleeping bags may require more material to provide the same heat retention as a mummy shaped sleeping bag, so rectangular sleeping bags are typically heavier than a mummy shaped counterpart.

Accordingly, there is a need for a single sleeping bag solution that can promote different levels of heat retention and comfortability in a simple, convenient, and cost-effective manner.

SUMMARY

An embodiment is directed to a sleeping bag comprising an insulated tubular member open at a first longitudinal end associated with a user's head and closed at a second longitudinal end associated with the user's feet, wherein the insulated tubular member comprises a bottom side configured to lay below the user, and wherein the insulated tubular member comprises a top side configured to lay above the user; a first material comprising an outer shell of the tubular member; a second material comprising an inner liner of the tubular member; insulation material enclosed by the outer shell and the inner liner; an expansion panel positioned on the top side of the insulated tubular member, further comprising; a first end positioned nearest the first longitudinal end of the insulated tubular member and comprising a first width; a second end positioned nearest the second longitudinal end of the insulated tubular member and comprising a second width greater than the first width; a zipper, further comprising; a first portion attached to a first side of the expansion panel and running longitudinally along the top of the insulated tubular member; a second portion attached to a second side of the expansion panel and running longitudinally along the top of the insulated tubular member; and a zipper slider removably attached to at least one of the first portion and the second portion, wherein the zipper slider is configured to zip the first portion and the second portion together to close the expansion panel, and wherein the zipper slider is configured to unzip the first portion and the second portion to open the expansion panel.

DETAILED DESCRIPTION

The present disclosure describes particular embodiments and their detailed construction and operation. The embodiments described herein are set forth by way of illustration only and not limitation. Those skilled in the art will recognize, in light of the teachings herein, that there may be a range of equivalents to the exemplary embodiments described herein. Most notably, other embodiments are possible, variations can be made to the embodiments described herein, and there may be equivalents to the components, parts, or steps that make up the described embodiments. For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

Disclosed herein is an extendable sleeping bag with an expandable panel that may alter the layout, thermal properties, and comfort of the sleeping bag. According to various aspects herein, the sleeping bag may comprise an expandable panel on or about a middle of a top portion of the sleeping bag. The expandable panel may be open/expanded and closed/retracted using a zipper. The expandable panel and the rest of the sleeping bag may be built from a continuous structure, including, but not limited to an outer shell that is resistant to environmental elements, an inner liner that is configured to provide comfort while in use, and an insulating material contained within the outer shell and the inner liner to provide heat retention and padding for a user.

The sleeping bag may comprise a series of baffle compartments, also known as baffles or baffle cells, that compartmentalize the insulation material within sections of the sleeping bag. The baffles are configured to provide efficient heat retention and redistribution of the insulation material, while still providing some structure to prevent the insulation material from moving freely about the sleeping bag in between the outer shell and the inner liner.

Figure 1:
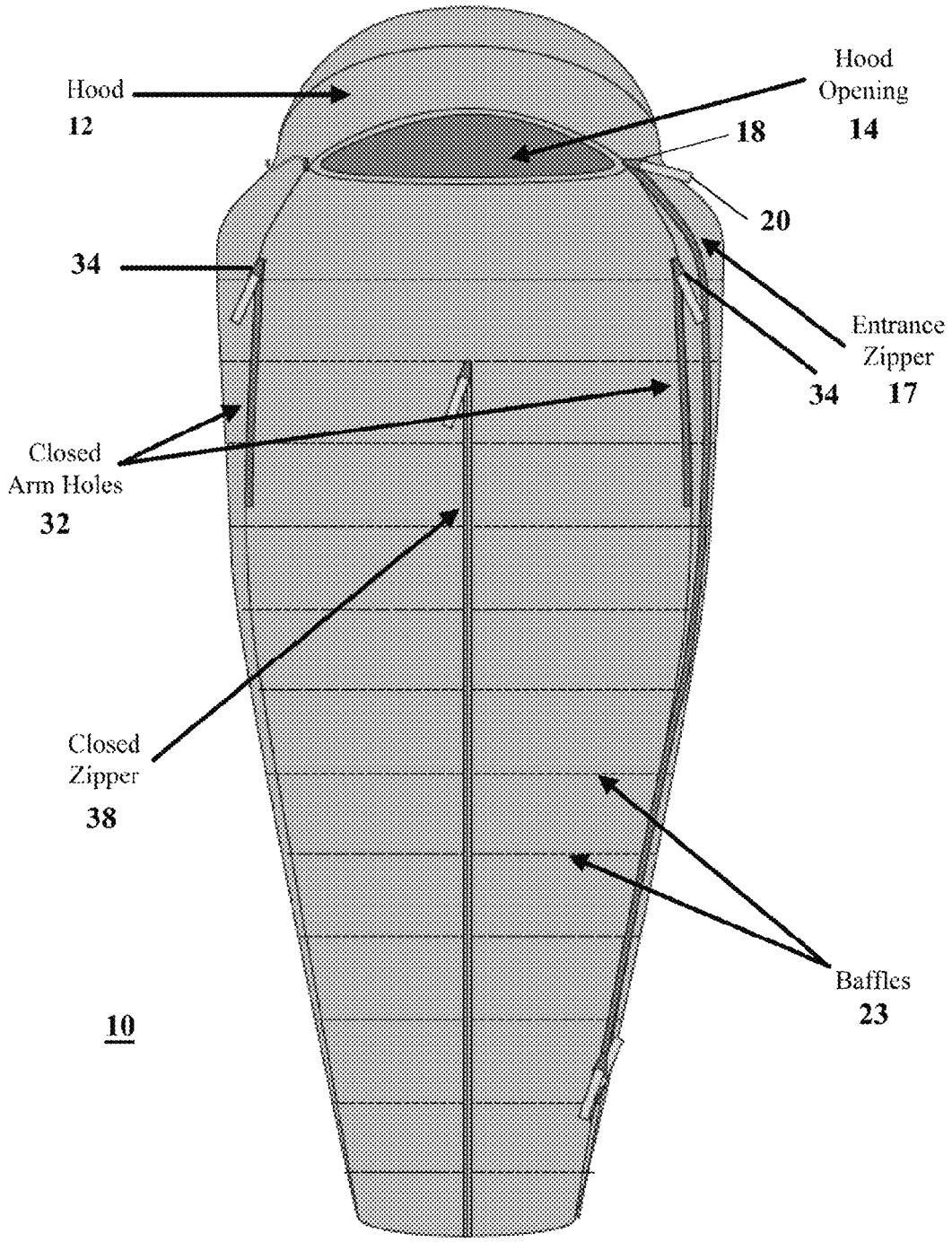
FIG. 1 is a top view of a sleeping bag with an expansion panel in a closed configuration.

FIG. 1 shows a top view of an example sleeping bag in a configuration in which an expandable panel is closed/hidden. In the example shown, the sleeping bag is in a configuration commonly described as a "mummy bag" or "mummy-style sleeping bag." The type of sleeping bag shown is called a mummy bag due to the tapered shape of the sleeping bag, as well as the partially enclosed hood at the top. The sleeping bag features a taper that generally progresses from a greater width at an end of the sleeping bag near the head and shoulders, and the sleeping bag comprises a gradually decreasing width as the sleeping bag progresses towards the foot end. A user laying inside of the sleeping bag has a relatively limited range of movement, especially at the foot end. Such sleeping bags are configured to retain heat from a user's body so as to provide sufficient warmth for the user during sleep, the mummy-style bag also reduces the quantity of "dead volume" in the sleeping bag, which may increase an effective quantity of retained heat in the sleeping bag. For example, traditional sleeping bags are typically rectangular, or substantially rectangular, and the foot end of the traditional sleeping bags have much more space near the foot end than in the mummy-style sleeping bag. The additional volume in the foot end of the traditional sleeping bag captures more air than in the confined mummy-style bag and takes more body warmth to heat the interior of the traditional style bag. Moreover, the larger foot end of traditional sleeping bags creates more surface area on the outside of the bag as compared to the mummy-style bag, and the increased surface area leads to increased heat transfer (and heat loss) as compared to the mummy-style bag.

Figure 2A:
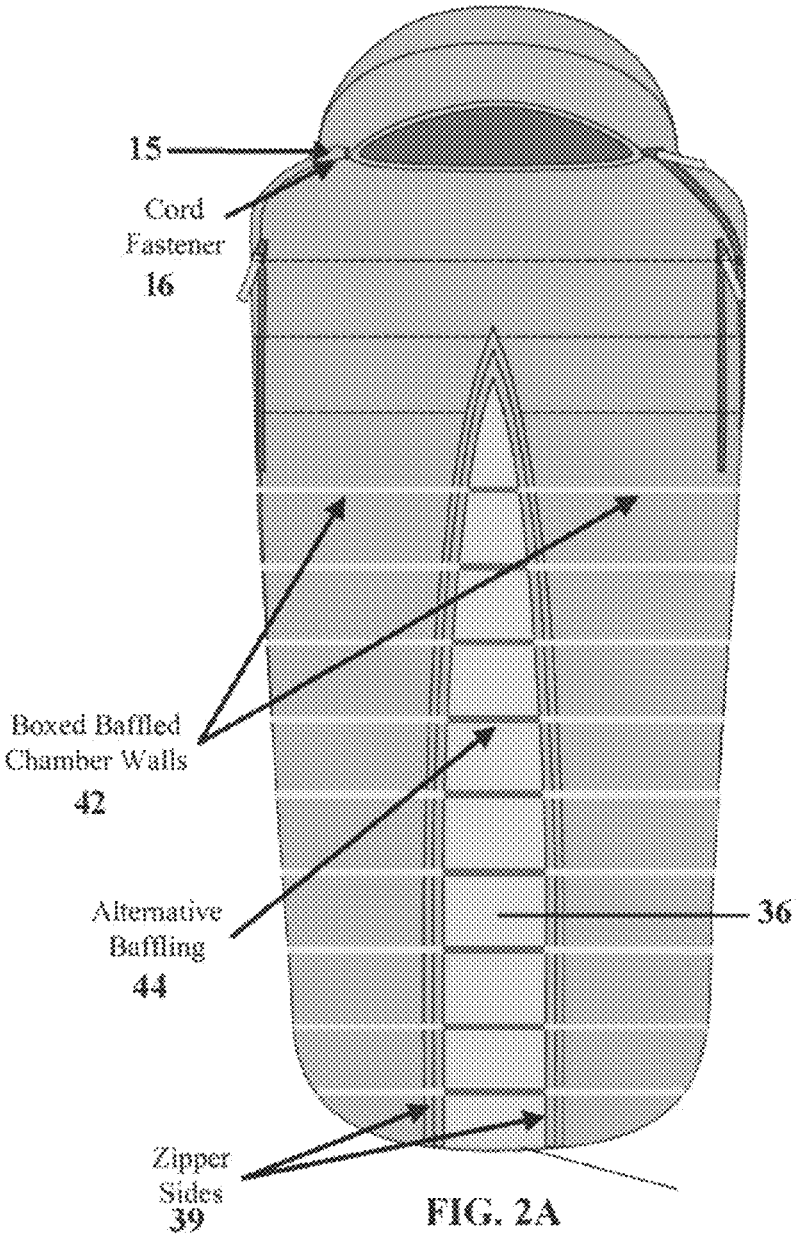
FIG. 2A is a head-foot view of the sleeping bag with the expansion panel in the open configuration.

Accordingly, in the embodiment shown in FIG. 1, the sleeping bag 10 is in a state that provides a relatively high amount of retained heat and can be used in a colder environment. Furthermore, the hood 12 is configured to prevent heat loss as well. Without hoods, sleeping bags typically have large openings at the head end and allow heat to be lost through the top of the sleeping bags. However, the hood 12, as shown in FIG. 1, shrinks the effective size of the hood opening 14 at the head end of the sleeping bag. The hood opening 14 is shown as substantially smaller than a traditional opening at the head end of a sleeping bag. Additionally, the hood opening 14 may be further constricted to reduce heat loss. A cord, strap, or other apparatus 15 (shown in FIG. 2A) may be coupled to an edge of the hood opening 14 and configured to cinch the hood opening closed. In some instances, while a user is inside the mummy-style bag, the hood opening may be cinched around the face of the user, effectively closing the hood opening to minimize heat loss through any openings in the mummy bag, and held in place by a cord fastener 16 as shown in FIG. 2A. The hood also provides extra padding to users to provide a more comfortable sleeping experience.

Users may enter the sleeping bag using the entrance zipper 17. Due to the intentionally limited size of the hood opening, it would be inconvenient, if not impossible, for a user to enter the sleeping bag through the hood opening. The entrance zipper 17 may begin at a corner of the hood opening, such that when the entrance zipper 17 is unzipped the top of the sleeping bag may be peeled back, revealing the interior of the sleeping bag. Partially opening the top portion of the sleeping bag provides a large opening for a user to enter the interior of the sleeping bag. The entrance zipper 17 may comprise a zipper slider 18 that includes a tab 20. The tab 20 may be made of coarse or otherwise high-grip material to provide a convenient hold to operate the entrance zipper 17.

Figure 5:
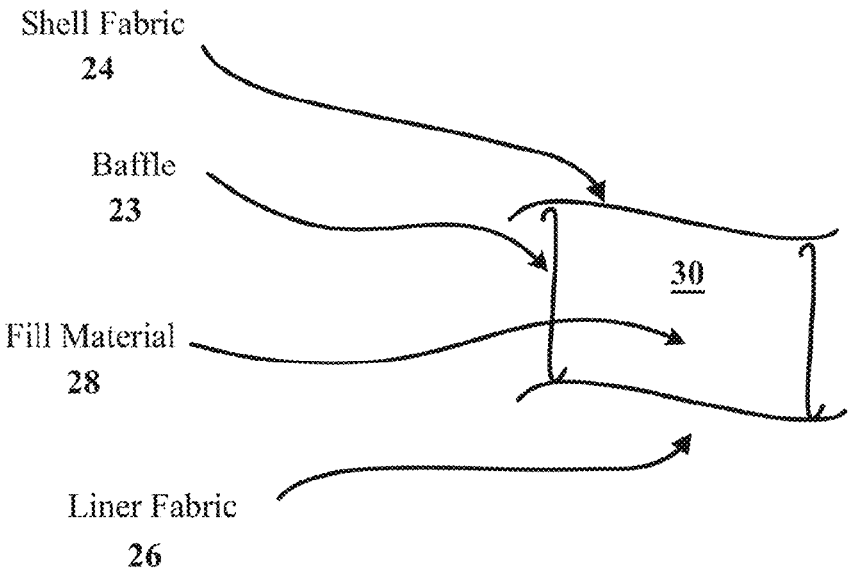
FIG. 5 shows an exemplary baffle cell looking longitudinally through the baffle cell.

FIG. 1 also illustrates the baffles 23 sewn into the sleeping bag 10. The sleeping bag may comprise an outer shell fabric 24, as shown in FIG. 5, using a first material that is generally resistant to environmental factors. The outer shell fabric 24 may be made of a durable nylon or polyester material, and the outer shell may be further imbued with a water resistant coating. The sleeping bag may further comprise an inner liner fabric layer 26 that is designed to provide comfort to a user. The inner liner 26 may comprise fabrics such as cotton, fleece, silk, synthetic materials, or the like. Situated between the outer shell 24 and the inner liner 26 is fill material 28 that provides insulation intended to trap body heat inside the sleeping bag and provide a suitably warm enclosure. The fill material 28 may be made of any lightweight, insulating material, for example goose down or synthetic insulation. The baffles are sewn into the sleeping bag between the outer shell 24 and the inner liner 26 to prevent the insulation material from migrating freely throughout the sleeping bag in between the outer shell and the inner liner.

The baffles 23 may be made of a synthetic material, for example nylon or polyester, and the baffles may be made of a mesh to reduce weight while still providing proper functioning baffles. The baffles 23 are coupled to and between the inside of the outer shell and inner liner layers as more fully illustrated in FIG. 5. The baffles essentially create a box 30, i.e., a boxed baffle, that is filled with the insulating fill material as shown in FIG. 5. Each boxed baffle chamber may share a baffle wall with a neighboring baffle chamber. Together, the baffle chambers provide insulation for the entire length of the sleeping bag. A different type of baffle may be used by directly stitching together the outer shell 24 and inner liner layers 26 to form sewn through baffles. Though sewn through baffles may be simple to execute, the sewn through baffles may lead to additional heat loss due to the lack of insulation at the seams of the baffles. Either of the baffles may wrap around the circumference of the sleeping bag in channels.

FIG. 1 further illustrates arm holes 32 with zippers 34 to close the arm holes 32 when not in use. When opened, the arm holes 32 may enable a user to sleep with their arms outside of the sleeping bag to partially cool off, or the bring their arms inside the sleeping bag and zipper the arm holes closed when desiring to warm up. The arm holes may have other convenience factors. For example, a user in the sleeping bag may wish to free their arms to reach for something outside of the sleeping bag. However, it may be inconvenient to reach out of the sleeping bag through the hood opening, especially if the hood opening is cinched tight. The zippers at the arm holes may be opened, either from the inside of the sleeping bag or from outside the sleeping bag, and a user may put their arm through the arm hole. To facilitate easy operation of the arm hole zipper, a zipper slider may end in a tab that is made of coarse or otherwise high-grip material to facilitate opening or closing the arm hole zipper.

Figure 2B:
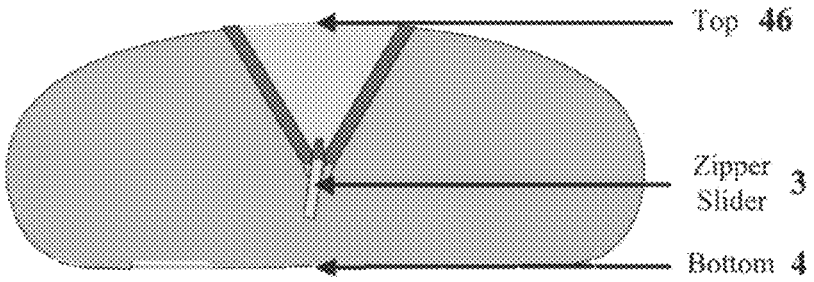
FIG. 2B is an exemplary view of the sleeping bag looking at the bottom of the sleeping bag with the expansion panel in the open configuration on the top.

FIGS. 2A and 2B show head-foot and bottom-top views of the sleeping bag, respectively. The configuration shown in FIGS. 2A and 2B illustrates the sleeping bag with the expansion panel 36 in the open and expanded position. The expansion panel may be substantially triangular, and the narrower side of the triangular expansion panel may be situated nearer to the head end of the sleeping bag, while the wider side of the triangular expansion panel may be situated near to the foot end of the sleeping bag. By unzipping an expansion zipper 38 on the top of the sleeping bag, the expansion panel 36 may be unfolded and the sleeping bag configuration may be changed. For example, while the expansion panel 36 is open, the shape of the sleeping bag may be altered, the thermal properties of the sleeping bag may be altered, or both may be altered. As shown in FIG. 1, the example sleeping bag is in a mummy-style configuration, with a generally tapered shape from a wider area near the head end and a narrower area near the foot end. However, unzipping the expansion zipper reveals the expansion panel and asymmetrically increases the cross-sectional area of the sleeping bag. For example, near the head end of the sleeping bag the expansion panel comes nearly to a point or is otherwise generally narrow, so the portion of the sleeping bag near the head end does not expand much, if at all. However, near the foot end of the sleeping bag the expansion panel is wider, leading to a larger increase in the cross-sectional area of the sleeping bag near the foot end. In some embodiments, deploying the expansion panel may convert the sleeping bag from a mummy-style bag to a rectangular sleeping bag. In some embodiments, deploying the expansion panel may convert the sleeping bag from a mummy-style bag to a semi-rectangular sleeping bag.

As shown in FIG. 2A, the expansion zipper with zipper slider 38 may unzip the zipper sides 39 past an end seam 40 of the sleeping bag, and the expansion zipper may zip nearly all the way or all of the way to the bottom side of the sleeping bag, or any other suitable stopping point. Though not shown, the expansion zipper may originate adjacent to the hood opening, or the expansion zipper may originate closer to the foot end of the sleeping bag, or the like. The expansion zipper may be unzipped to reveal further baffling within the expansion panel.

The baffles within the expansion panel may be the same as or different than the baffles on the main portion of the sleeping bag. For example, the baffles 42 within the main portion of the sleeping bag may be 5 cm tall, the baffles on the main portion of the sleeping bag may be 7 cm tall, or the baffles on the main portion of the sleeping bag may be any suitable height to facilitate an effective quantity of insulation material in the baffle chambers. The baffles 44 within the expansion panel may be shorter than the baffles 42 within the main portion of the sleeping bag. For example, the baffles 44 within the expansion panel may be 3 cm tall. By reducing the height of the baffles 44 within the expansion panel, the insulation in the expansion panel may be reduced compared to the insulation in the main portion of the sleeping bag. Accordingly, expanding the expansion panel may cause the interior of the sleeping bag to be cooler than when the expansion panel is closed.

In one embodiment, the portion of the baffles 44 within the expansion panel may comprise a different type of baffle than the baffles 42 within the main portion of the sleeping bag. For example, the baffles 42 within the main portion of the sleeping bag may comprise a boxed baffle, and the baffles 44 within the expansion panel may comprise a sewn through baffle, thus providing a different quantity of heat retention at the expansion panel as compared to at the main portion of the sleeping bag. In another embodiment, only some of the baffles 44 within the expansion panel are sewn through. For example, every second baffle in the expansion panel may be sewn through, and the other baffles may be boxed baffles as with the boxed baffles 42 of the main portion of the sleeping bag. Ultimately, altering the construction and makeup of the baffles 44 within the expansion panel provide a high level of control of the heating and cooling capabilities of the sleeping bag with the deployed expansion panel.

Figure 3:
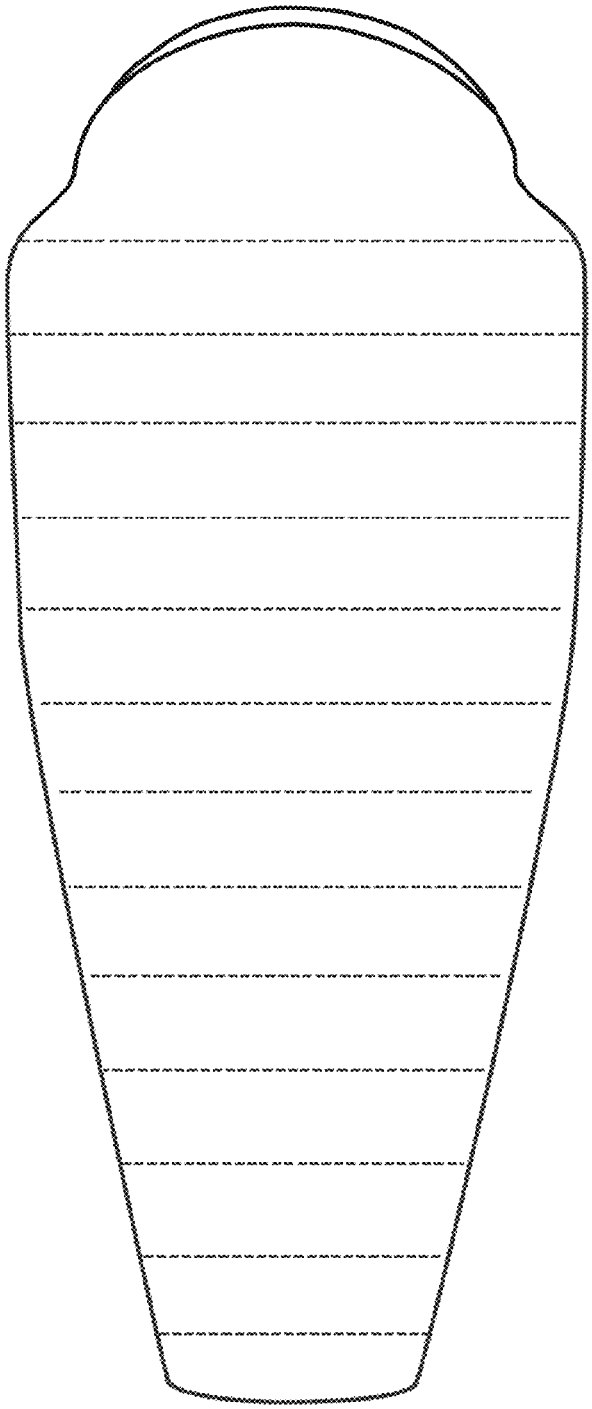
FIG. 3 is a bottom view of the sleeping bag with the expansion panel in the closed configuration.

FIG. 3 illustrates a bottom or back view of the sleeping bag. The portion of the sleeping bag visible in FIG. 3 may be in contact with the ground during use. The bottom view of the sleeping bag shows the continuous nature of the baffle chambers as shown previously in FIGS. 1, 2A, and 2B. Due to the continuous baffle chambers, insulation material may be moved around the sleeping bag from the top of the sleeping bag to the bottom of the sleeping bag, or vice versa. Manipulating the location of some or all of the insulating material within the baffle chambers provide a further level of control to the heating retention properties of the sleeping bag.

Figure 4A:
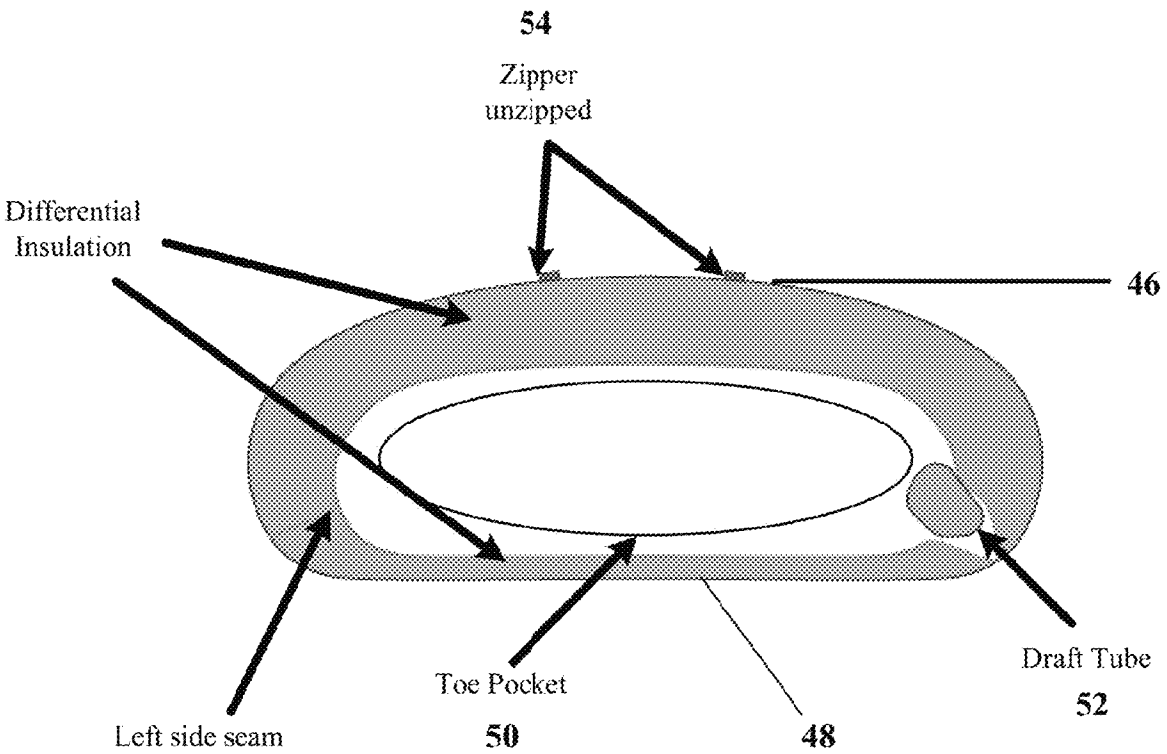
FIG. 4A is a planar view of the sleeping bag looking down through the top of the sleeping bag with the expansion panel in the open configuration.

FIG. 4A is a cross-sectional top-bottom view of the sleeping bag described herein. The view is shown without the hood to illustrate the interior of a cross-section of the sleeping bag more clearly. The sleeping bag may employ a differential offset construction. For example, the top 46 of the sleeping bag may comprise a larger volume than the bottom 48 of the sleeping bag. Therefore, more insulation may be filled into the top portion of the sleeping bag than the bottom portion of the sleeping bag, and the increased insulation on the top of the sleeping bag may provide additional heat retention than an even fill construction.

A toe pocket 50 is shown in the present view of the sleeping bag. The toe pocket 50 may be a further insulated portion of the interior of the sleeping bag to provide additional heat retention to the lower extremities of a user. The toe pocket 50 may be made from a same or different material than the inner liner layer.

A draft tube 52 is shown along the right side of the view of the sleeping bag. Along the right side in the current view is the entrance zipper to the sleeping bag. Because the entrance zipper allows for the sleeping bag to be separated and opened for entry there is normally no insulation at the entrance zipper. Accordingly, all along the entrance zipper heat may lost at a much greater rate than in the rest of the sleeping bag. Therefore, the draft tube 52 is placed inside the sleeping bag, sewn to the interior liner fabric 26 along the top 46 of the sleeping bag and substantially following the path of the entrance zipper. The draft tube 52 provides additional insulation near the entrance zipper to prevent some heat loss that would otherwise occur. Though not shown, draft tubes may also be present in the hood. The hood draft tubes may provide a tighter seal around a user's head and prevent heat loss through the hood opening.

FIG. 4A further shows a view of the sleeping bag with the expansion panel in the opened configuration. The two portions of the expansion zipper 54 are spread apart, and the portion of the sleeping bag in between the two zipper halves represents the width of the expansion panel. Though not shown herein, the sleeping bag at the expansion panel may have a different insulation height than at the rest of the main portion of the sleeping bag. Due to the expansion panel being deployed, the left side seam (typically situated on the farthest left portion of the sleeping bag) and the entrance zipper are both nearly even with the bottom portion of the sleeping bag. As the middle of the top of the sleeping bag widens with deployment of the expansion panel, the rest of the sleeping bag expands to the side and widens the interior volume of the sleeping bag.

Figure 4B:
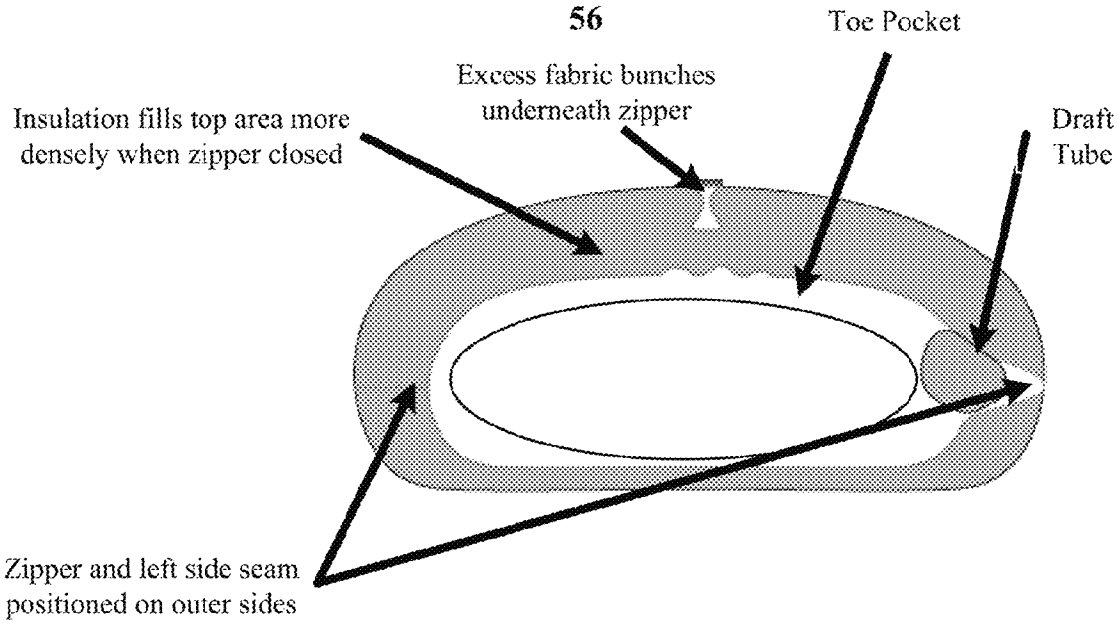
FIG. 4B is a planar view of the sleeping bag looking down through the top of the sleeping bag with the expansion panel in the closed configuration.

FIG. 4B shows a top-bottom view of the sleeping bag but with the expansion panel in the closed configuration. In particular, the two portions 54 of the zipper shown in FIG. 4A are zipped together by the expansion zipper, bunching the fabric 56 of the expansion panel near the middle of the top of the sleeping bag. As illustrated, the wavy material 56 bunches together in the middle of the sleeping bag and provides at least one of a thicker and denser insulated portion. Because the baffle chambers are continuous throughout the expansion panel, the insulation may migrate toward the middle of the top of the sleeping bag with the expansion panel in the closed configuration. Furthermore, the left side seam and the entrance zipper are shown in a normal configuration, in which both are situated at the far sides of the sleeping bag. With the expansion panel stowed away, the volume of the interior of the sleeping bag is reduced.

FIG. 5 illustrates an example baffle chamber 30. The vertical left and right walls of the baffle chamber 30 are the baffles 23, and the baffles 23 may be made of a nylon or polyester mesh construction. The baffles 23 may provide structure to the baffle chambers 30 and support to the coupling of the outer shell 24 and the inner liner 26 of the sleeping bag. The baffle is stitched to the outer layer of the sleeping bag on the top, and the baffle is stitched to the inner liner layer of the sleeping bag on the bottom. The outer shell and inner liner complete the boxed baffle chamber, and the insulation fill material is spread within the baffle chamber to provide heat retention and padding for the sleeping bag.

Figure 6:
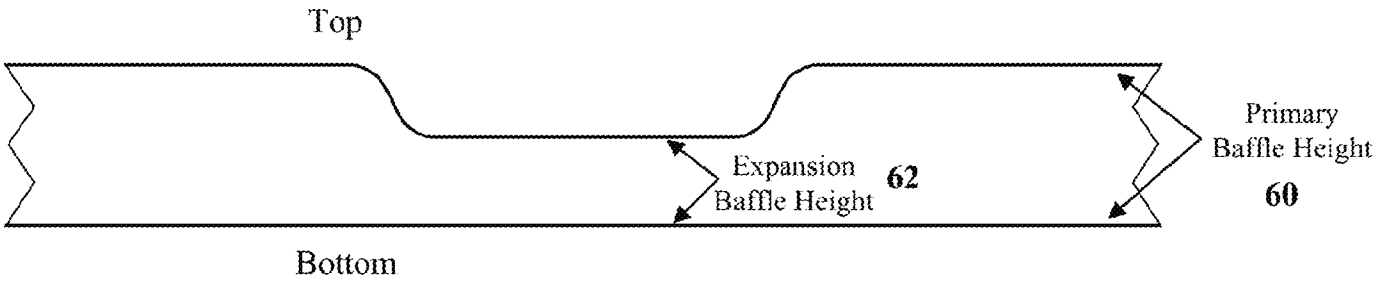
FIG. 6 shows an embodiment of the present disclosure in which the expansion panel baffles are a different height than the baffles of the main portion of the sleeping bag.

FIG. 6 shows an embodiment in which the primary height 60 of the baffle chamber in the expansion panel is different than the expansion height 62 of the baffle chamber of the rest of the main portion of the sleeping bag. For example, the baffles 42 within the main portion of the sleeping bag may be 5 cm tall, the baffles 42 within the main portion of the sleeping bag may be 7 cm tall, or the baffles 42 within the main portion of the sleeping bag may be any suitable height to facilitate an effective quantity of insulation material in the baffle chambers. The baffle chambers 44 within the expansion panel may be shorter than the baffles in the main portion of the sleeping bag. For example, the baffle chambers 44 in the expansion panel may be 3 cm tall. By reducing the height 62 of the baffles 44 in the expansion panel, the insulation in the expansion panel may be reduced compared to the insulation in the main portion of the sleeping bag. Accordingly, deploying the expansion panel and revealing the shorter baffle chambers may cause the interior of the sleeping bag to be cooler than when the expansion panel is closed.

Further embodiments, not shown per se, but represented via different combinations of the components of the embodiments that are illustrated in FIGS. 1-6, include an interior pocket that is coupled to the inner liner layer of the sleeping bag and may provide storage for personal or other items. The sleeping bag is described in the Figures with a single expansion panel situated in the top middle portion of the sleeping bag, though the single expansion panel may be situated in a different area of the sleeping bag. For example, the single expansion panel may be situated on the bottom middle of the sleeping bag, or the expansion panel may be situated on a side of the sleeping bag. The expansion zipper may comprise a plurality of zipper sliders for the single expansion panel, allowing for a modular approach to deploying portions of the single expansion panel, for example based on the preference of a user. The top of the expansion zipper may be covered by a piece of fabric to prevent accidentally unzipping the expansion zipper. The fabric may be folded over and sewn in a manner that makes the expansion zipper unable to snag and unzip unintentionally. Alternatively, the fabric may incorporate a snap fastener, such that the expansion zipper may be zipped up and the fabric may be snapped in place over the expansion zipper. The single expansion panel may be substantially wider at the foot end than at the head end and may cause the foot end of the sleeping bag to be wider than the head end of the sleeping bag. The single expansion panel may be stowed away using any combination of fasteners other than a zipper. For example, the sides of the single expansion panel running longitudinally along the sleeping bag may be coupled with opposing faces of Velcro or opposing snap fasteners. The Velcro or snap fasteners may be engaged to hide the single expansion panel and disengaged to deploy the expansion panel.

In an embodiment, a sleeping bag comprising: an insulated tubular member open at a first longitudinal end associated with a user's head and closed at a second longitudinal end associated with the user's feet, wherein the insulated tubular member comprises a bottom side configured to lay below the user, and wherein the insulated tubular member comprises a top side configured to lay above the user; a first material comprising an outer shell of the tubular member; a second material comprising an inner liner of the tubular member; insulation material enclosed by the outer shell and the inner liner; an expansion panel positioned on the top side of the insulated tubular member, further comprising; a first end positioned nearest the first longitudinal end of the insulated tubular member and comprising a first width; a second end positioned nearest the second longitudinal end of the insulated tubular member and comprising a second width greater than the first width; a zipper, further comprising; a first portion attached to a first side of the expansion panel and running longitudinally along the top of the insulated tubular member; a second portion attached to a second side of the expansion panel and running longitudinally along the top of the insulated tubular member; and a zipper slider removably attached to at least one of the first portion and the second portion, wherein the zipper slider is configured to zip the first portion and the second portion together to hide the close panel, and wherein the zipper slider is configured to unzip the first portion and the second portion to open the expansion panel.

In the embodiment, further comprising a hood extending from the first longitudinal end, wherein the hood comprises a hood opening that is smaller than an opening associated with the first longitudinal end of the insulated tubular member, and wherein the hood opening is open toward the top side of the insulated tubular member.

In the embodiment, wherein the hood opening comprises a hollow portion along the edge of the hood opening, and wherein a cord is positioned inside the hollow portion of the edge of the hood opening.

In the embodiment, wherein the cord may be drawn and fastened to constrict the hood opening.

In the embodiment, further comprising a draft tube associated with the hood opening, wherein the draft tube comprises a padded tube configured to reduce an area of the hood opening to reduce heat exchange through the hood opening.

In the embodiment, wherein the expansion panel comprises a substantially triangular shape, wherein a narrow portion of the triangular shape is positioned toward the first end of the expansion panel, and wherein a wide portion of the triangular shape is positioned toward the second end of the expansion panel.

In the embodiment, wherein zipping the zipper closed causes the sleeping bag to comprise a mummy-like sleeping bag configuration, and wherein unzipping the zipper causes the sleeping bag to comprise a substantially rectangular sleeping bag configuration.

In the embodiment, wherein the insulation comprises at least one of down insulation and synthetic insulation.

In the embodiment, further comprising an offset differential construction, wherein the offset differential construction comprises: a first quantity of insulation in the top portion of the insulated tubular member; and a second quantity of insulation in the bottom portion of the insulated tubular member, wherein the first quantity of insulation is greater than the second quantity of insulation.

In the embodiment, wherein the insulated tubular member comprises a plurality of baffled chambers, wherein each baffled chamber runs around the circumference of the insulated tubular member.

In the embodiment, wherein each sidewall of the plurality of baffled chambers comprises at least one of a nylon or polyester mesh.

In the embodiment, wherein portions of the plurality of baffled chambers in the expansion panel comprise sewn through baffles, wherein a sewn through baffle comprises stitching the first material of the outer shell directly to the second material of the inner liner.

In the embodiment, wherein every second baffle wall of the plurality of baffled chambers comprises a sewn through baffle, and wherein each other baffle wall comprises a boxed baffle.

In the embodiment, wherein each portion of the plurality of baffled chambers associated with the expansion panel comprises a first height, and wherein each other portion of the plurality of baffled chambers is associated with a second height taller than the first height.

In the embodiment, wherein the zipper comprises a plurality of zipper sliders.

In the embodiment, wherein the second longitudinal end of the insulated tubular member comprises an insulated pocket to provide extra warmth to the user's feet, wherein the insulated pocket comprises at least one of additional insulation material enclosed by the outer shell and the inner liner and a separate insulated pocket positioned inside of the inner liner.

In the embodiment, further comprising one or more pockets coupled to an inside of the second material comprising the inner liner of the tubular member.

In the embodiment, wherein the zipper is a first zipper, further comprising a second zipper running longitudinally along a side of the insulated tubular member, wherein unzipping the second zipper exposes an inner portion of the sleeping bag, and wherein the the second zipper is at least partially unzipped to provide access to the inner portion of the sleeping bag.

In the embodiment, further comprising a draft tube associated with the second zipper, wherein the draft tube is attached in the inner portion of the sleeping bag and runs longitudinally along the side of the insulated tubular member along the length of the second zipper.

In the embodiment, wherein the zipper is a first zipper, further comprising a second zipper for opening and closing at least one arm hole.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The present disclosure describes particular embodiments and their detailed construction and operation. The embodiments described herein are set forth by way of illustration only and not limitation. Those skilled in the art will recognize, in light of the teachings herein, that there may be a range of equivalents to the exemplary embodiments described herein. Most notably, other embodiments are possible, variations can be made to the embodiments described herein, and there may be equivalents to the components, parts, or steps that make up the described embodiments. For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

The terms and descriptions used above are set forth by way of illustration only and are not meant as limitations. Those skilled in the art will recognize that those and many other variations, enhancements and modifications of the concepts described herein are possible without departing from the underlying principles of the invention. The scope of the invention should therefore be determined only by the following claims and their equivalents.

What is claimed:

1. A sleeping bag comprising:

an insulated tubular member open at a first longitudinal end associated with a user's head and closed at a second longitudinal end associated with the user's feet, wherein the insulated tubular member comprises a bottom side configured to lay below the user, and wherein the insulated tubular member comprises a top side configured to lay above the user;

a first material comprising an outer shell of the tubular member;

a second material comprising an inner liner of the tubular member;

insulation material enclosed by the outer shell and the inner liner;

an expansion panel positioned on the top side of the insulated tubular member, further comprising:

a first end positioned nearest the first longitudinal end of the insulated tubular member and comprising a first width;

a second end positioned nearest the second longitudinal end of the insulated tubular member and comprising a second width greater than the first width;

a plurality of baffled chambers running circumferentially around the insulated tubular member, wherein at least one of the plurality of baffled chambers passes through the expansion panel:

a zipper, further comprising:

a first portion attached to a first side of the expansion panel and running longitudinally along the top side of the insulated tubular member;

a second portion attached to a second side of the expansion panel and running longitudinally along the top side of the insulated tubular member; and a zipper slider removably attached to at least one of the first portion and the second portion, wherein the zipper slider is configured to zip the first portion and the second portion together to close the expansion panel, and wherein the zipper slider is configured to unzip the first portion and the second portion to open the expansion panel.

2. The sleeping bag of claim 1, further comprising a hood extending from the first longitudinal end, wherein the hood comprises a hood opening that is smaller than an opening associated with the first longitudinal end of the insulated tubular member, and wherein the hood opening is open toward the top side of the insulated tubular member.

3. The sleeping bag of claim 2, wherein the hood opening comprises a hollow portion along the edge of the hood opening, and wherein a cord is positioned inside the hollow portion of the edge of the hood opening.

4. The sleeping bag of claim 3, wherein the cord may be drawn and fastened to constrict the hood opening.

5. The sleeping bag of claim 2, further comprising a draft tube associated with the hood opening, wherein the draft tube comprises a padded tube configured to reduce an area of the hood opening to reduce heat exchange through the hood opening.

6. The sleeping bag of claim 1, wherein the expansion panel comprises a substantially triangular shape, wherein a narrow portion of the triangular shape is positioned toward the first end of the expansion panel, and wherein a wide portion of the triangular shape is positioned toward the second end of the expansion panel.

7. The sleeping bag of claim 1, wherein zipping the zipper closed causes the sleeping bag to comprise a mummy-style sleeping bag configuration, and wherein unzipping the zipper causes the sleeping bag to comprise a substantially rectangular sleeping bag configuration.

8. The sleeping bag of claim 1, wherein the insulation material comprises at least one of down insulation and synthetic insulation.

9. The sleeping bag of claim 1, further comprising an offset differential construction, wherein the offset differential construction comprises:

a first quantity of insulation in the top side of the insulated tubular member; and a second quantity of insulation in the bottom side of the insulated tubular member, wherein the first quantity of insulation is greater than the second quantity of insulation.

10. The sleeping bag of claim 1, wherein each sidewall of the plurality of baffled chambers comprises at least one of a nylon or polyester mesh.

11. The sleeping bag of claim 1, wherein a portion of the at least one of the plurality of baffled chambers in the expansion panel comprises sewn through baffles, wherein a sewn through baffle comprises stitching the first material of the outer shell directly to the second material of the inner liner.

12. The sleeping bag of claim 11, wherein every second baffle wall of the plurality of baffled chambers comprises a sewn through baffle, and wherein each other baffle wall comprises a boxed baffle.

13. The sleeping bag of claim 1, wherein a first portion of the at least one of the plurality of baffled chambers associated with the expansion panel comprises a first height, and wherein each other portion of the at least one of the plurality of baffled chambers is associated with a second height taller than the first height.

14. The sleeping bag of claim 1, wherein the zipper comprises a plurality of zipper sliders.

15. The sleeping bag of claim 1, wherein the second longitudinal end of the insulated tubular member comprises an insulated pocket to provide extra warmth to the user's feet, wherein the insulated pocket comprises at least one of additional insulation material enclosed by the outer shell and the inner liner and a separate insulated pocket positioned inside of the inner liner.

16. The sleeping bag of claim 1, further comprising one or more pockets coupled to an inside of the second material comprising the inner liner of the tubular member.

17. The sleeping bag of claim 1, wherein the zipper is a first zipper, further comprising a second zipper running longitudinally along a side of the insulated tubular member, wherein unzipping the second zipper exposes an inner portion of the sleeping bag, and wherein the second zipper is at least partially unzipped to provide access to the inner portion of the sleeping bag.

18. The sleeping bag of claim 17, further comprising a draft tube associated with the second zipper, wherein the draft tube is attached in the inner portion of the sleeping bag and runs longitudinally along the side of the insulated tubular member along a length of the second zipper.

19. The sleeping bag of claim 1, wherein the zipper is a first zipper, further comprising a second zipper for opening and closing at least one arm hole.

* * * * *